US005892422A

United States Patent [19]

Montaigu et al.

[11] Patent Number: 5,892,422

[45] Date of Patent: Apr. 6, 1999

[54] MOTOR VEHICLE STARTER CONTACTOR INCORPORATING AN AUXILIARY CONTROL RELAY

[75] Inventors: Hervé Montaigu, Lyon; André Liadakis, Salacon, both of France

[73] Assignee: Valeo Equipments Electriques Moteur, Creteil, France

[21] Appl. No.: 923,019

[22] Filed: Sep. 3, 1997

[30] Foreign Application Priority Data

Sep. 3, 1996 [FR] France ..... 96 10821

[51] Int. Cl.[6] ..... H01H 67/02

[52] U.S. Cl. ..... 335/126; 335/131

[58] Field of Search ..... 335/126, 131

[56] References Cited

U.S. PATENT DOCUMENTS 5,227,751 7/1993 Shiroyama et al. ..... 335/126
5,677,656 10/1997 Mauch et al. ..... 335/126

FOREIGN PATENT DOCUMENTS 2 724 421 3/1996 France .
42 42 930 6/1994 Germany .
44 32 297 3/1996 Germany .

OTHER PUBLICATIONS

French Search Report dated 6 Jun. 1997.

*Primary Examiner*—Lincoln Donovan
*Attorney, Agent, or Firm*—Morgan & Finnegan, LLP

[57] ABSTRACT

A contactor for a motor vehicle starter comprises a contactor coil, a movable contactor core actuated by a control rod, and a fixed contactor core. It also has an electromagnetic auxiliary control relay which includes a movable relay core carrying a movable contact ring which is arranged for cooperation with at least one pair of fixed relay contacts, carried by a fixed annular contact carrier plate. The relay coil, the contact carrier plate, and the movable contact ring are arranged in axial succession, in that order towards the front of the contactor, and are disposed between the fixed core and the movable contact of the contactor, so that the relay and the contactor are closed in opposite directions.

9 Claims, 1 Drawing Sheet

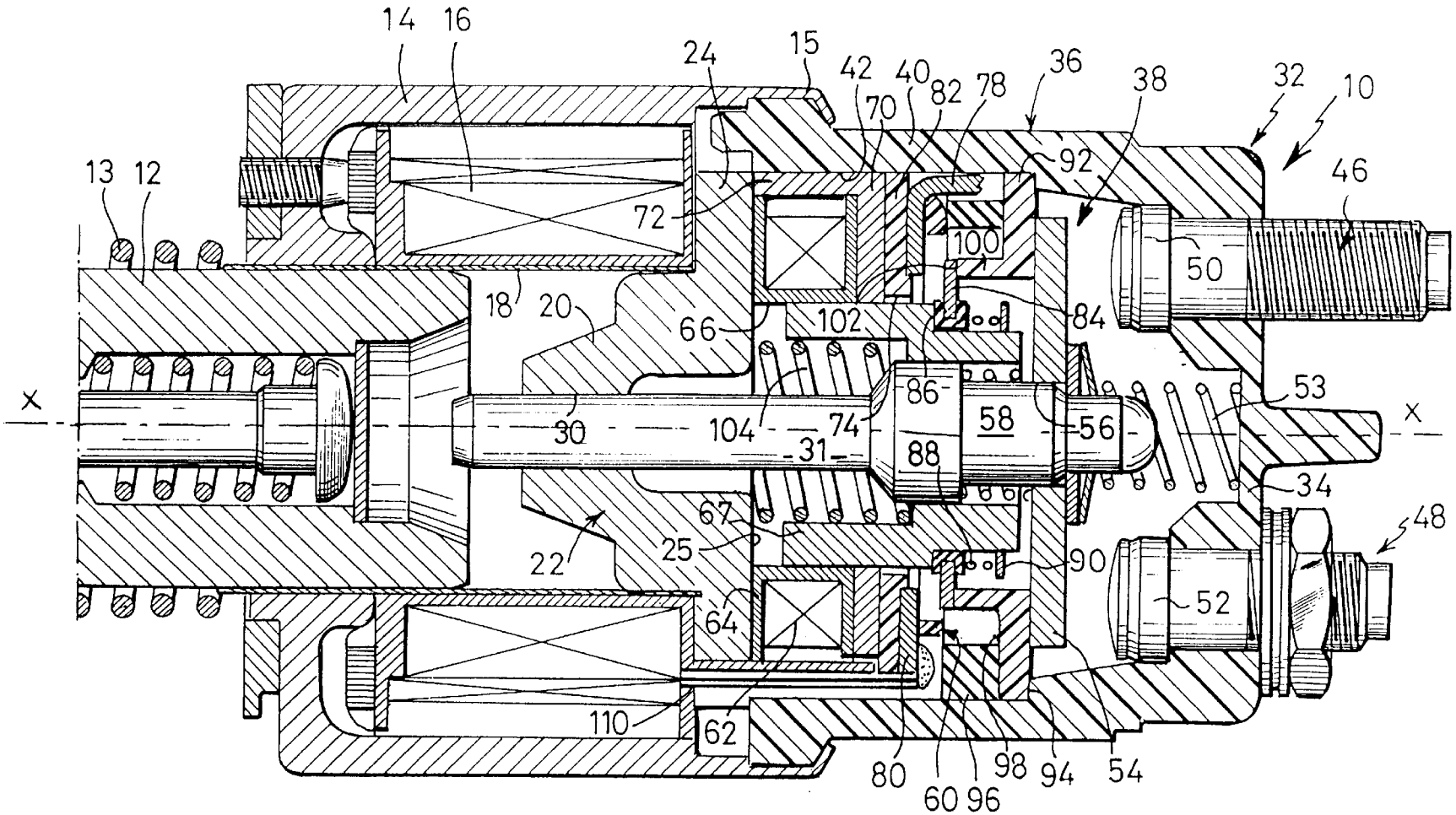
10
32
46
48
50
52
53
34
X
38
36
92
84
56
90
54
94
98
96
60
78
100
58
82
40
86
88
80
70
42
102
74
31
15
104
24
66
67
25
64
62
72
110
20
30
22
18
16
14
12
13
X

MOTOR VEHICLE STARTER CONTACTOR INCORPORATING AN AUXILIARY CONTROL RELAY

FIELD OF THE INVENTION

The present invention relates to motor vehicle starter contactors, and the like. More particularly, the invention relates to a contactor for a motor vehicle starter, of the type comprising an annular cylindrical armature, in which is arranged a solenoid coil, or contactor coil, that actuates an axially movable contactor core. This movable core acts on a control rod which extends through the centre of a fixed core in the form of a disc disposed at a front axial end of the armature. The control rod governs displacements of a movable contact, or movable contactor contact, which is adapted to cooperate with two fixed contacts, forming part of the power terminals connected in the power supply circuit for the motor of the starter. These fixed contact terminals are arranged in the base portion of an end cover that forms part of the casing of the contactors. A lateral skirt portion of the end cover defines an end cap chamber in which the movable contact is mounted, this chamber being part of the internal chamber of the contactor casing.

BACKGROUND OF THE INVENTION

In a known design of starter contactor, the contactor is controlled by an electromagnetic auxiliary relay which enables commands for controlling the contactor to be transmitted by means of a low current. As a result, the ignition switch of the vehicle no longer has to support a current of high intensity, which may typically be several tens of amperes: a current of the order of 1 ampere is perfectly sufficient to insure proper control of the contactor. Thanks to this arrangement, it is possible to reduce the dimensioning of the wiring and of the ignition switch associated with the ignition key.

In addition, a starter having an auxiliary control relay for the contactor can be governed easily and inexpensively by an electronic control circuit which may, in particular, take into account information relating to the locking of the steering lock of the vehicle, and which can include a control and safety system which takes care of any electrical overloads occurring in the operation of the starter.

In known designs, the auxiliary relay is typically fixed outside of the contactor, e.g. on the contactor itself; the relay may for example be carried on the starter casing or on the pedestal of the starter motor, or on an element of the bodywork of the vehicle.

In all the above mentioned cases, the auxiliary control relay has its own protective housing, with its own sealing means and its own wiring by which it is connected electrically to the control circuit and to the contactor. These designs therefore lead to particularly high costs, and to additional space requirements in the engine compartment of the vehicle.

With a view to incorporation of the relay within the contactor, and in order to overcome the problems just mentioned, it has previously been proposed to provide a contactor in which the end cap or cover of the contactor casing includes a chamber in which the auxiliary control relay is mounted. This design does enable the auxiliary relay to be protected, and reduces the length required for the various connecting cables.

In order to improve still further the incorporation of the auxiliary control relay into the contactor, it was proposed in French patent specification No. FR 2 724 421 A to provide a contactor which includes an auxiliary electromagnetic control relay mounted in the chamber in the end cap, between the fixed core and the movable contact of the contactor. The auxiliary relay includes a relay coil of generally annular form, within which a movable relay core is guided in axial sliding movement. The control rod extends through the centre of this movable relay core, and the latter carries a movable relay contact ring which, under the action of the relay coil, is adapted for cooperation with at least one pair of fixed relay contacts carried by a fixed, annular, contact carrier plate of insulating material. The contactor is further of a type in which the movable relay core is biassed resiliently towards an axial rest position.

In the design proposed in the above mentioned French patent specification, the auxiliary control relay, which generally has the form of a body of revolution, and through which the control rod for the movable contact of the contactor passes, is made in the form of a separate, attached, sub-assembly which is fixed by means of screws on the fixed magnetic core of the contactor.

Apart from the fact that the specific assembly operations for fitting the auxiliary control relay on the contactor are relatively complex, this design, taking the form of an independent component fitted in the interior of the contactor, results in a significant increase in the axial length of the contactor and also in its weight.

In addition, the detail design of the auxiliary control relay proposed in the above mentioned French patent specification makes it necessary, in order to determine the rest position of the movable contact ring of the auxiliary control relay, to make use of a stack of opposed springs, with precise axial dimensioning of the various components. It is therefore particularly difficult to determine reliably the axial rest position of the movable relay contact, and such a design makes it necessary to manufacture certain of the components of the auxiliary relay with very great precision.

DISCUSSION OF THE INVENTION

An object of the present invention is to propose an improvement in the design of a contactor of the type mentioned above, that is to say of the general type described and shown in French patent specification No. FR 2 724 421 A, such as to overcome the drawbacks just discussed.

According to the invention in a first aspect, a contactor for a motor vehicle starter, is of the type having a casing comprising an annular cylindrical armature and an end cap. The contactor is arranged within the armature. It has a contactor coil consisting of a solenoid coil that actuates an axially movable core which acts on a control rod which extends through the centre of a fixed contactor core in the form of a. The disc is disposed at a front axial end of the armature, being also of the type in which the control rod governs displacements of a movable contactor contact which is adapted to cooperate with two fixed power contact terminals. These terminals connect to the power supply circuit for the motor of the starter, the fixed power contact terminals being arranged in the base portion of the end cap. A lateral skirt portion defines an end cap chamber in which the movable contactor contact is mounted. This contactor is of the type comprising an auxiliary electromagnetic control relay which is mounted in the chamber in the end cap, between the fixed core and the movable contact of the contactor. The auxiliary relay includes a relay coil of generally annular form, within which there is guided in axial sliding movement a movable relay core through the centre of which the control rod extends. The movable relay core carries a movable contact ring which, under the action of the relay coil, is adapted for cooperation with at least one pair of fixed relay contacts carried by a fixed, annular, contact carrier plate of insulating material. The contactor is of the type in which the movable relay core is biassed resiliently towards an axial rest position, is characterised in that the relay coil, the contact carrier plate and the movable relay contact ring are arranged in an axial succession going from the rear towards the front of the contactor in that order, between the fixed core and the movable contact of the contactor.

According to a preferred feature of the invention, the movable relay core is biassed axially towards a fixed stop abutment in the form of an abutment ring disposed axially between the annular contact carrier plate and the movable contact of the contactor.

According to another preferred feature of the invention, the annular contact carrier plate and the abutment ring constitute an axial stack of components interposed between the front transverse end face of the fixed core of the contactor and a transverse shoulder of the end cap of the contactor. The said transverse shoulder is oriented towards the rear. Preferably with this arrangement, the axial stack of components includes an elastically compressed intermediate member. The elastically compressed member is preferably an annular element which is mounted in axial compression between the annular contact carrier plate and the abutment ring.

According to a further preferred feature of the invention, the movable relay core is biassed axially towards its rest position by a compression spring through which the control rod passes. The compression spring is interposed between the fixed core of the contactor and the movable core of the relay.

The movable relay core is preferably a hollow cylindrical sleeve which carries the movable contact ring. In preferred embodiments of this arrangement, the movable contact ring is adapted to be displaced axially with respect to the sleeve towards the front of the contactor, from a rest position towards which it is resiliently biassed by a spring for limiting the force applied between the movable contact ring and the fixed relay contacts.

Preferably, the relay coil includes an annular magnetic yoke which, in cross section through a transverse plane, has an L-shaped profile. This profile defines a first branch extending axially at the periphery of the coil, the first branch having its free end adjacent to the transverse front face of the fixed core of the contactor, and a second branch extending radially with its inner free end adjacent to the movable relay core.

According to the invention in a second aspect, a motor vehicle starter is equipped with a contactor in accordance with the first aspect of the invention.

Further features and advantages of the invention will appear more clearly on a reading of the following detailed description of one preferred embodiment of the invention, which is given by way of non-limiting example only and with reference to the accompanying drawing.

BRIEF DESCRIPTION OF THE DRAWING

The single FIGURE of the drawing is a view in axial cross section showing a starter contactor in accordance with the invention.

DESCRIPTION OF A PREFERRED EMBODIMENT OF THE INVENTION

The electromagnetic contactor 10 shown in the drawing is arranged to equip a starter (not shown) for a motor vehicle internal combustion engine.

In a manner known per se, the contactor 10 includes a movable contactor core 1 2 which acts on one end of a pivoting lever (not shown), the other end of which is coupled to the driving element of the starter head of the starter. The electromagnetic contactor 1 0 also has an external armature 14, which may also be referred to as the barrel or the casing body, and which is of annular generally cylindrical form with an axis X—X. Disposed inside the barrel 14 is, in particular, an annular solenoid winding or coil 16, also referred to here as the contactor coil. In this example, the coil 16 consists of two coaxial windings, as shown in the drawing.

The movable core 12 is mounted for sliding movement within a tubular skirt 18 which is fixed on the central portion 20 of a fixed contactor core 22. The fixed core 22 is generally in the form of a disc having a flat annular main portion 24 which lies in a transverse plane at right angles to the axis X—X, with the solenoid coil 16 and the tubular skirt 18, in the rear part of the external armature 14.

The armature 14 is extended axially forward, that is to say towards the right in the drawing, beyond the transverse front end face 25 of the disc-shaped main portion 24 of the fixed core 22, by a thin extension portion 15, the function of which will be explained later in this description.

The central portion 20 of the fixed core 22 has a central through hole 30, for guiding in sliding movement on the axis X—X, a control rod 31 on which the movable core 12 acts.

The contactor has a casing which consists generally of the armature (or casing body) 14 and an end cap 32 which is fixed to the open front end of the casing body 14. The end cap 32 is a molded component made from a suitable insulating material, for example a thermoplastics material. The end cap 32 is in the general form of a cylindrical pot centred on the axis X—X, and comprises a radially extending terminal base portion 34 lying at right angles to the axis X—X, with a cylindrical side wall or skirt portion 36 projecting from the base portion 34.

The main part of the skirt portion 36 defines a cylindrical internal chamber 38 of the contactor, and in particular an end cap chamber. The rear end portion 40 of the skirt 36, having the largest diameter of the latter, defines an internal cavity 42 of generally cylindrical form, which is bounded on its rear side by the front transverse face 25 of the disc-shaped main portion 24 of the fixed contactor core 22. The front end of the armature 14 is extended by the thin axial end portion 15, which is upset radially inwards over an external terminal bead of the end cap skirt portion 36, thereby sealingly securing the end cap 32 and armature 14 together.

In a manner known per se, the contactor 10 has two fixed power terminals of electrically conductive material, 46 and 48, which are encapsulated in the moulding of the base portion 34 of the end cap 32. Each fixed terminal 46, 48 has an exposed contact head 50, 52 respectively, within the chamber 38 and orientated generally in a plane at right angles to the axis X—X.

Again in a manner known per se, the control rod 31 carries a movable contactor contact 54 in the form of a rectangular plate which has a central through hole 56. The control rod 31 has a portion 58 of enlarged diameter which is engaged in this hole 56.

In the rest position shown in the drawing, the movable core 12, the control rod 31 and the movable contact 54 are biassed resiliently, towards the left in the drawing, by a return spring 13 which is interposed between the movable contactor core 12 and the radial rear end face of the armature 14, and also by a spring 53 which is interposed between the base portion 34 of the end cap 32 and the movable contactor contact 54.

The contactor 10 is equipped with an auxiliary control relay 60. This auxiliary relay 60 includes a relay coil 62 which consists of a winding arranged in a coil housing or body 64. As can be seen in the drawing, the transverse cross section of the coil body 64 is substantially U-shaped, with parallel branches which extend radially outwardly, while the central portion, joining these two parallel branches together, defines a central bore 66 of the coil body 64. A movable core 67 of the relay 60 is mounted in the central bore 66 for sliding movement. The movable core 67 is in the form of a stepped sleeve, the rear portion of which, having the largest diameter, is guided in sliding movement within the body 64 of the coil 62 of the auxiliary control relay 60. The coil body 64 is axially adjacent to the transverse front end face 25 of the fixed core 22 of the contactor.

The coil body 64 is surrounded by a magnetic circuit which consists of a magnetic yoke 70 in the form of an annular metallic member with an L-shaped transverse cross section. The L-shaped cross section of the yoke 70 comprises an axial branch 72 and a radial branch. The free rear end of the axial branch 72 is in axial abutment against the transverse front end face 25 of the fixed core 22 of the contactor 10.

The other branch of the yoke 70, extending radially in a transverse plane, has an inner free end 74 adjacent to the cylindrical outer wall of the portion having the largest diameter of the stepped sleeve constituting the movable core 67 of the auxiliary relay 60. Accordingly, the yoke 70 has a central hole of the same diameter as the bore 66 of the coil body 64, and the movable core 67 of the auxiliary relay 60 extends through this hole, in which it can slide axially.

One end of the winding of the coil 62 is connected to ground, i.e. the metallic structure of the contactor, through the fixed core 22 of the contactor.

In this arrangement of contactor in which the yoke 70 is adjacent to the fixed core 22, it is found that the fixed core forms part of the magnetic circuit of the auxiliary control relay 60, which greatly simplifies the design and manufacture of the auxiliary relay.

The auxiliary control relay 60 has two fixed relay contacts 78 and 80, which may for example be diametrically opposed as shown, and which are made in the form of contact elements encapsulated by molding within an annular contact carrier 82. The contact carrier 82 is in the form of a plate which is adjacent to the yoke 70. The fixed contacts 78 and 80 extend radially inwardly, close to the movable core 67, which carries a movable contact ring 84 of the relay. This contact ring 84 surrounds the front portion, i.e. the portion having the smallest diameter, of the stepped sleeve that constitutes the movable core 67 of the auxiliary relay. The contact ring 84 is mounted on this front portion of the sleeve for axial movement.

The movable contact ring 84 is fitted in an insulating internal guide ring of U-shaped cross section (shown in the drawing but not indicated by a reference numeral). The contact ring 84 is biassed axially into abutment against the external radial shoulder 86 of the movable core sleeve 67 which is defined by the junction between the two portions of the sleeve having different diameters. This biassing action is exerted by a spring 88, which bears at its other end against a resilient ring 90 fixed on the sleeve 67. The purpose of the spring 88 is to limit the force applied between the contact ring 84 and the fixed contacts 78 and 80 when the auxiliary control relay 60 is closed, in order to avoid crushing and deformations, both of the fixed contacts 78 and 80 and of the movable contact ring 84.

The axial stack consisting of the relay coil 62, the annular plate 82 that carries the contacts 78 and 80, and the movable core 67 with its movable contact ring 84, is retained axially in the cavity 42 which is that part of the internal chamber 38 of the contactor having the largest diameter, by means of a retaining and abutment ring 92. This ring 92 has the general form of a rigid annular disc, and it bears axially at the front against a radial internal shoulder 94 of the end cap 32. This shoulder 94 is oriented axially towards the rear, i.e. towards the left in the drawing.

An annular elastic block 96, which may for example be made of a suitable elastomeric material, is mounted in axial compression against the rear transverse face 98 of the retaining and abutment ring 92 and the transverse front face, in facing relationship with it, of the contact carrier plate 82. The annular elastic block 96 provides axial compression when the various components of the contactor are assembled together, and following the operation of seaming which involves upsetting the thin extension portion 15 of the armature 1 4. The block 96 is engaged against the transverse front face 25 of the fixed core 22 of the contactor 10, thus putting into axial compression the stack of components consisting of the auxiliary relay coil 62 and the contact carrier plate 82.

The retaining and abutment ring 92 includes in its center a tubular axial extension 100 which projects axially towards the rear, and which has an annular rear transverse end face 102 that constitutes an annular abutment surface. The movable contact ring 84, and therefore also, indirectly, the sleeve constituting the movable relay core 67 of the auxiliary contact relay 80, bears axially against the annular abutment surface 102, under the action of a helical compression spring 104 which biasses the movable core 67 towards its rest position, that is to say from left to right in the drawing. The helical return spring 104 is interposed between the transverse front face 25 of the fixed core 22 and the internal radial shoulder defined by the junction of the two portions, of different diameter, of the stepped movable core 67.

In order to connect the auxiliary control relay 60 to the other electrical components of the contactor 10 in a manner known per se, the common output end 110 of the two windings of the contactor coil 16 is soldered to the fixed contact 80. The other fixed contact 78 is connected to a starter control terminal (not shown) mounted on the end cap 32 of the contactor, by an electrical connection which is again not shown in the drawings.

Actuation of the auxiliary control relay 60, from its rest position shown in the drawing, is obtained by energising the relay coil 62. This causes the movable core 67 of the auxiliary relay to be displaced axially from front to rear, that is to say from right to left with reference to the drawing. This moves the movable contact ring 84 forward, until it comes into abutment against the facing portions of the fixed contacts 78 and 80.

As has been mentioned above, the spring 88 avoids crushing of the contacts. It will also be noted that the rearward direction of actuation to close the contacts of the auxiliary control relay is opposed to the forward direction of actuation of the contactor as the contacts of the contactor itself are then immediately closed. This prevents the occurrence of any additional crushing of the various contacts due to the impacts produced as the movable contact 54 comes into contact with the fixed power terminals 50 and 52 of the contactor 10.

What is claimed is:

1. A motor vehicle starter contactor having a hollow, annular, cylindrical casing with an open first end, a hollow end cap secured on the first end, the end cap having a base portion and a lateral skirt portion extending from the base portion and defining within the end cap an internal chamber open towards the hollow casing, the casing defining a contactor axis; a pair of fixed power terminals carried by the base portion of the end cap; an axially movable contractor contact within the internal chamber; a control rod extending axially in the internal chamber and carrying the movable contactor contact; a fixed contactor core in the form of a disc mounted radially in the first end of the casing, the fixed core having a central hole mounting the control rod for axial displacement of the control rod therein, whereby the control rod selectively displaces the movable contactor contact into and out of engagement with the fixed power contacts; a movable contactor core, the casing mounting the movable contactor core within the hollow thereof for axial displacement of the movable contactor core whereby the movable contactor core acts on the control rod to effect the axial displacement of the control rod; a contactor coil mounted in the casing for actuating the movable contactor core in the axial displacement thereof; and an electromagnetic auxiliary control relay disposed in the casing and within the internal chamber in the end cap, between the fixed core and the movable contact of the contactor, the auxiliary relay comprising: a generally annular relay coil; an axially movable relay core, the relay coil mounting the relay core axially in the relay coil for axial sliding movement of the relay core therein, the control rod extending through the center of the relay core; a movable contact ring carried by said relay core; a fixed annular contact carrier plate of insulating material; at least one pair of fixed relay contacts carried by said carrier plate for cooperation with said relay contact ring upon displacement of said contact ring under the action of said relay coil; and means for biasing said relay core resiliently towards an axial rest position, wherein said relay coil, said contact carrier plate, and said movable relay contact ring are arranged within the internal chamber, in axial succession in that order towards the first end of the casing, and disposed between the fixed core and the movable contact of the contactor.

2. A contactor according to claim 1, further including a fixed stop abutment in the form of an abutment ring disposed between said annular contact carrier plate and the movable contact of the contactor, said biasing means for biasing the movable relay contact ring towards said abutment ring.

3. A contactor according to claim 2, wherein said relay coil, said contact carrier plate and said abutment ring constitute an axial stack of components, the end cap having a transverse shoulder, the fixed core of the contactor having a transverse end face, and said axial stack being interposed between said end face of the fixed core and said transverse shoulder of the end cap.

4. A contactor according to claim 3, wherein said axial stack of components further includes an elastically compressed intermediate member.

5. A contactor according to claim 4, wherein said elastically compressed member is an annular element compressed axially between said contact carrier plate and said abutment ring.

6. A contactor according to claim 1, further including a compression spring interposed between the fixed contactor core and said movable relay core, the control rod extending through said compression spring, said compression spring engaging said movable relay core to bias movable relay core to bias said movable relay core elastically to a rest position.

7. A contactor according to claim 1, wherein said movable relay core is a hollow cylindrical sleeve carrying said movable contact ring.

8. A contactor according to claim 7, wherein said hollow cylindrical sleeve defines a rest position of said movable contact ring and carries said movable contact ring axially from said rest position, the auxiliary relay further including a force limiting spring biasing said movable contact ring towards said rest position to limit pressure between said movable contact ring and said fixed relay contact.

9. A contactor according to claim 1, wherein the relay coil includes an annular magnetic yoke having an L-shaped profile in transverse cross section, to define an axial first branch and a radial second branch, said first branch extending axially at the periphery of the relay coil, the fixed core of the contactor having a transverse face, said first branch having a free end adjacent to said transverse face of the fixed core, said second branch oriented radially and having a free edge adjacent to the movable relay core.

* * * * *